US009302879B2

(12) United States Patent
Matsumoto

(10) Patent No.: US 9,302,879 B2
(45) Date of Patent: Apr. 5, 2016

(54) POSTPROCESSING APPARATUS AND IMAGE FORMING SYSTEM

(71) Applicant: FUJI XEROX CO., LTD., Tokyo (JP)

(72) Inventor: Masashi Matsumoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/021,560

(22) Filed: Sep. 9, 2013

(65) Prior Publication Data

US 2014/0284863 A1 Sep. 25, 2014

(30) Foreign Application Priority Data

Mar. 19, 2013 (JP) ..... 2013-056419

(51) Int. Cl.

| | |
|---|---|
| ***B65H 39/00*** | (2006.01) |
| ***B65H 43/08*** | (2006.01) |
| ***B65H 31/02*** | (2006.01) |
| ***G03G 15/00*** | (2006.01) |
| ***B42C 1/12*** | (2006.01) |

(52) U.S. Cl.

CPC ..... *B65H 43/08* (2013.01); *B42C 1/12* (2013.01); *B65H 31/02* (2013.01); *G03G 15/5062* (2013.01); *G03G 15/6582* (2013.01); *B65H 2301/4213* (2013.01); *B65H 2301/42146* (2013.01); *B65H 2301/4382* (2013.01); *B65H 2301/4505* (2013.01); *B65H 2301/5111* (2013.01); *B65H 2511/10* (2013.01); *B65H 2511/20* (2013.01); *B65H 2511/22* (2013.01); *B65H 2511/222* (2013.01); *B65H 2511/512* (2013.01); *B65H 2553/414* (2013.01); *B65H 2553/81* (2013.01); *B65H 2701/1241* (2013.01); *B65H 2701/12411* (2013.01); *B65H 2801/27* (2013.01); *G03G 2215/00831* (2013.01)

(58) Field of Classification Search

CPC ..... B65H 2301/42146; B65H 2301/4214; B65H 2511/512; B65H 39/00; B65H 37/06

USPC ..... 399/407–410; 270/1.01, 1.03, 58.07, 270/58.08, 58.12, 58.17

See application file for complete search history.

(56) References Cited

U.S. PATENT DOCUMENTS

| | | | | |
|---|---|---|---|---|
| 6,145,825 | A | 11/2000 | Kunihiro et al. | |
| 2008/0211158 | A1* | 9/2008 | Fukasawa et al. | 270/1.01 |
| 2008/0315489 | A1* | 12/2008 | Iguchi et al. | 270/37 |

FOREIGN PATENT DOCUMENTS

| | | | |
|---|---|---|---|
| JP | B2-3748710 | | 2/2006 |
| JP | 2007-008690 | A | 1/2007 |
| JP | 2008-308306 | A | 12/2008 |

(Continued)

OTHER PUBLICATIONS

Machine English translation of JP 2008/308306, Dec. 2008.*

(Continued)

*Primary Examiner* — Jennifer Simmons
(74) *Attorney, Agent, or Firm* — Oliff PLC

(57) ABSTRACT

A postprocessing apparatus includes a support unit that supports a sheet that is transported, an abutment unit against which a leading end of the sheet supported by the support unit abuts, a postprocessing unit that performs a postprocessing operation on the sheet abutting against the abutment unit, a detection unit that detects an image formed at a predetermined position on the sheet and detects a position of the image when the sheet abuts against the abutment unit, and a changing unit that changes a position of the abutment unit relative to the postprocessing unit on the basis of the position of the image detected by the detection unit.

6 Claims, 9 Drawing Sheets

(56) References Cited

FOREIGN PATENT DOCUMENTS

| | | | |
|---|---|---|---|
| JP | 2008308305 A | * | 12/2008 |
| JP | 2012173532 A | * | 9/2012 |

OTHER PUBLICATIONS

Jun. 23, 2015 Office Action issued in Japanese Application No. 2013-056419.

* cited by examiner

| SIZE AND ORIENTATION OF SHEET | | DISTANCE L |
|---|---|---|
| A3 | SEF | La |
| LEGAL | SEF | |
| A4 | SEF | |
| LETTER | SEF | |
| A4 | LEF | Lb |
| LETTER | LEF | |

POSTPROCESSING APPARATUS AND IMAGE FORMING SYSTEM

CROSS-REFERENCE TO RELATED APPLICATIONS

This application is based on and claims priority under 35 USC 119 from Japanese Patent Application No. 2013-056419 filed Mar. 19, 2013.

BACKGROUND

Technical Field

The present invention relates to a postprocessing apparatus and an image forming system.

SUMMARY

According to an aspect of the invention, a postprocessing apparatus includes a support unit that supports a sheet that is transported, an abutment unit against which a leading end of the sheet supported by the support unit abuts, a postprocessing unit that performs a postprocessing operation on the sheet abutting against the abutment unit, a detection unit that detects an image formed at a predetermined position on the sheet and detects a position of the image when the sheet abuts against the abutment unit, and a changing unit that changes a position of the abutment unit relative to the postprocessing unit on the basis of the position of the image detected by the detection unit.

BRIEF DESCRIPTION OF THE DRAWINGS

An exemplary embodiment of the present invention will be described in detail based on the following figures, wherein.

DETAILED DESCRIPTION

Hereinafter, an exemplary embodiment of the present invention will be described in detail with reference to the drawings.

Sheet Processing System 1

Figure 1:
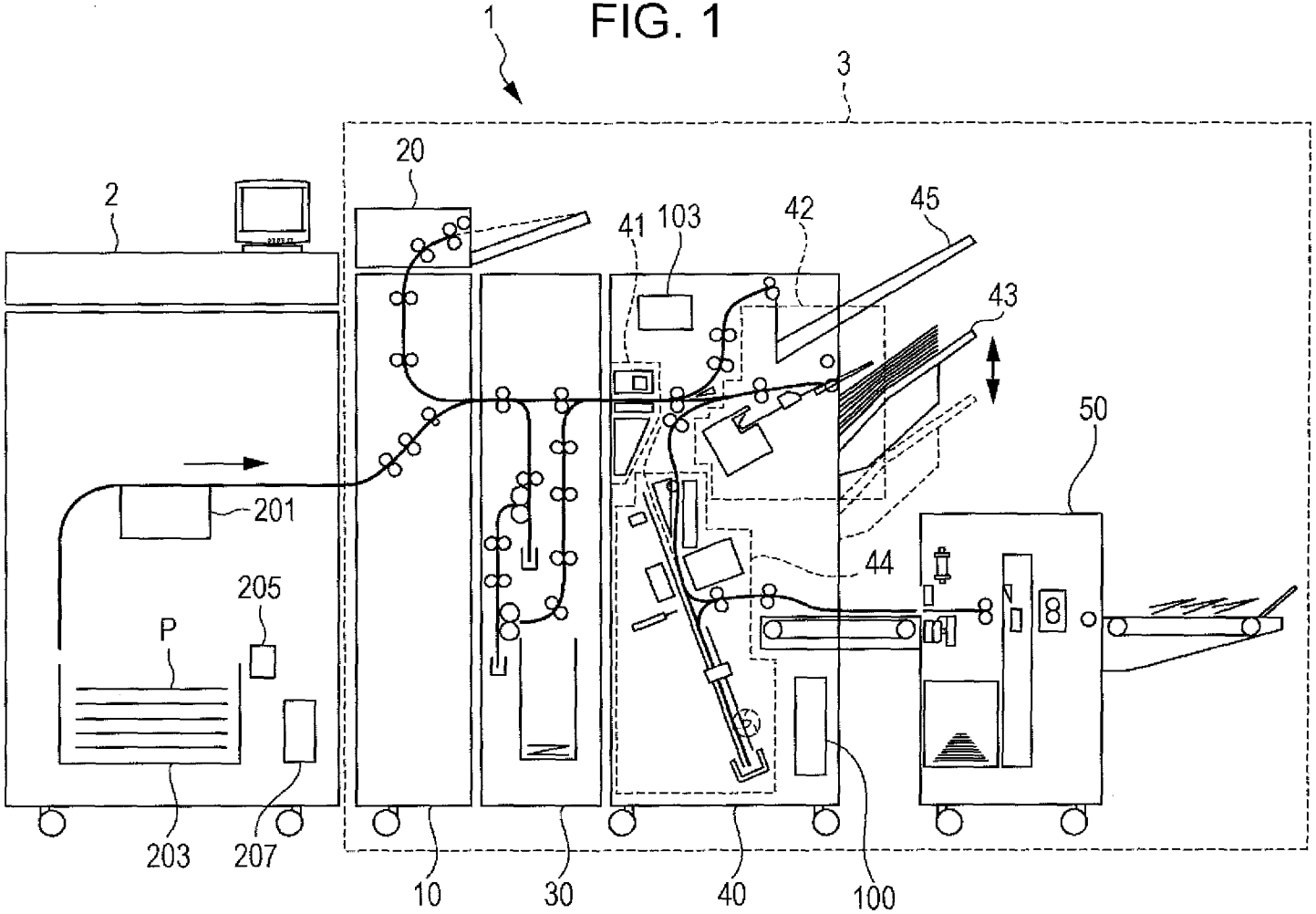
FIG. 1 is an overall view of a sheet processing system according to the exemplary embodiment.

FIG. 1 is an overall view of a sheet processing system 1 (image forming system) according to the exemplary embodiment.

As illustrated in FIG. 1, the sheet processing system 1 includes an image forming apparatus 2 and a sheet processing apparatus 3. The image forming apparatus 2 forms a color toner image on a sheet P by using, for example, an electrophotographic method. The sheet processing apparatus 3 performs a predetermined processing operation on the sheet P, on which the image forming apparatus 2 has formed a toner image.

The image forming apparatus 2 includes an image forming unit 201, a sheet feeding unit 203, a size detection sensor 205, and an image forming controller 207. The image forming unit 201 forms an image by using an electrophotographic method. The sheet feeding unit 203 supplies the sheet P to the image forming unit 201. The size detection sensor 205 detects the size and orientation of the sheet P, which is contained in the sheet feeding unit 203. The image forming controller 207, which is a central processing unit (CPU) under program control, controls various mechanisms of the image forming apparatus 2.

The image forming unit 201 may be, for example, an inkjet printer. The sheet feeding unit 203 includes regulation guides (not shown), which respectively regulate a side edge and a trailing end of the sheet P contained in the sheet feeding unit 203. The size detection sensor 205 outputs the detection result of the positions of the regulation guides.

The sheet processing apparatus 3 includes a transport device 10 and a slip-sheet supply device 20. The transport device 10 transports the sheet P, which has been output from the image forming apparatus 2. The slip-sheet supply device 20 supplies a ship sheet, such as a thick sheet or a windowed sheet, to the sheet P, which is transported by the transport device 10. The sheet processing apparatus 3 further includes a folding device 30 and a first postprocessing device 40. The folding device 30 performs a folding operation, such as inner tri-folding (C-folding), outer tri-folding (Z-folding), or the like, on the sheet P, which has been transported from the transport device 10. The first postprocessing device 40, which is disposed on the downstream side of the folding device 30, performs punching, end stapling, and saddle stapling on the sheet P. The sheet processing apparatus 3 further includes a second postprocessing device 50, which is disposed on the downstream side of the first postprocessing device 40. The second postprocessing device 50 performs additional postprocessing operations on a stack of the sheets P (booklet) that has been saddle-folded/saddle-stapled. The sheet processing apparatus 3 further includes a controller 100 and an operation panel 103. The controller 100, which is a central processing unit (CPU) under program control, controls the entirety of the sheet processing system 1. The operation panel 103 receives various commands from a user. The controller 100 and the operation panel 103 may be included in any section of the sheet processing system 1. For example, they may be included in the image forming apparatus 2.

First Postprocessing Device 40

As illustrated in FIG. 1, the first postprocessing device 40 includes a punching unit 41, an end stapling unit 42, and a first stacker 43. The punching unit 41 punches the sheet P. The end stapling unit 42 staples an end of a stack of the sheets P (stacked sheets). The first stacker 43 stacks the stacks of the sheets P, which have been stapled at the end, in such a way that a user may easily pick up stacks of the sheets P. The first postprocessing device 40 further includes a saddle stapling unit 44 and a second stacker 45. The saddle stapling unit 44 saddle-folds/saddle-staples the stack of the sheets P to make a double-spread booklet. The second stacker 45 stacks the sheets P on which the first postprocessing device 40 has not performed postprocessing or has only performed punching.

Figure 2:
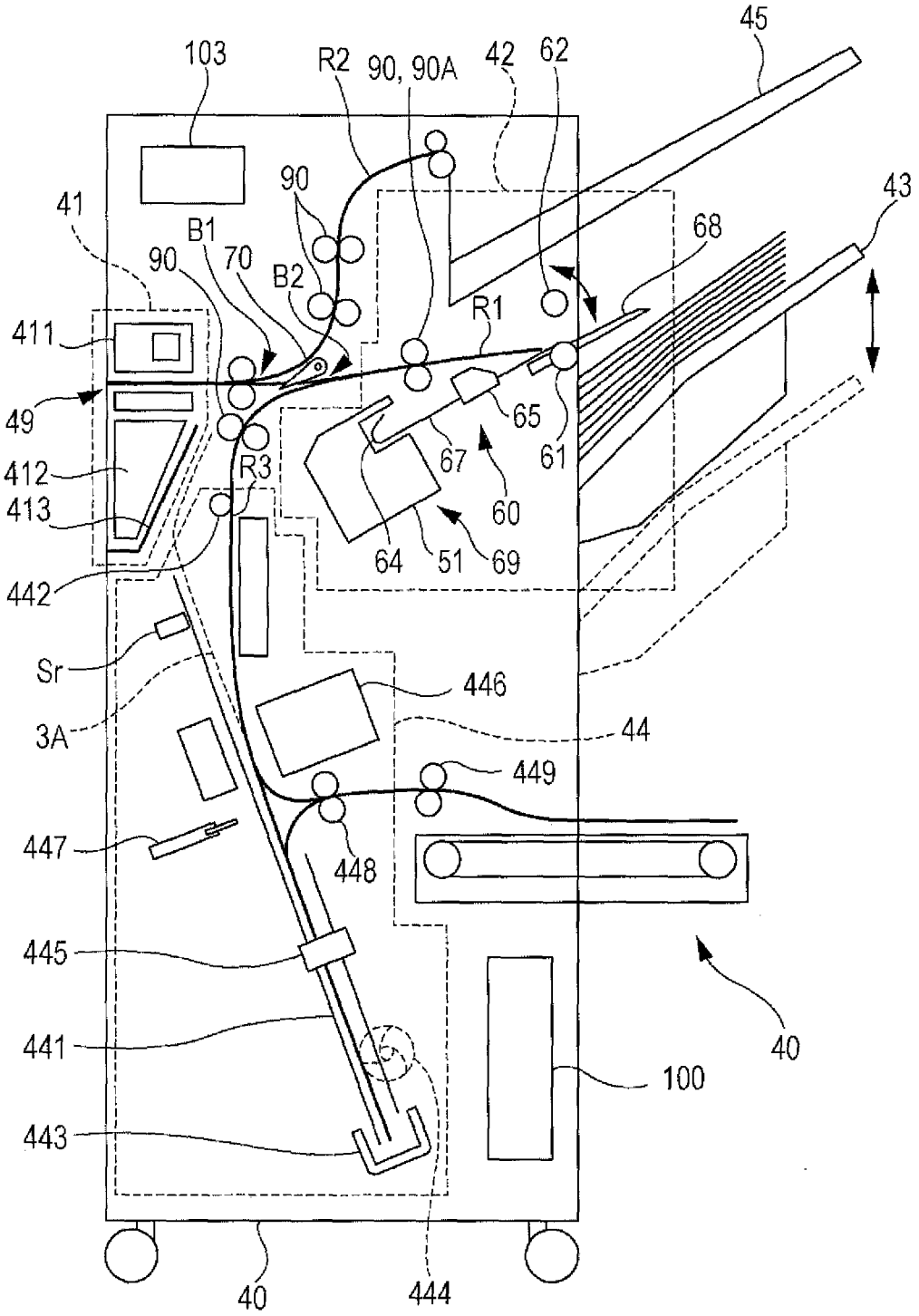
FIG. 2 illustrates a first postprocessing apparatus.

FIG. 2 illustrates the first postprocessing device 40.

As illustrated in FIG. 2, the first postprocessing device 40 has an inlet 49 for receiving the sheet P from the folding device 30 (see FIG. 1). In the first postprocessing device 40, a first transport path R1 extends from the inlet 49 to the end stapling unit 42. The sheet P received at the inlet 49 is transported to the end stapling unit 42 through the first transport path R1.

In the first postprocessing device 40, a second sheet transport path R2 branches off from the first transport path R1 at a first branching region B1. The sheet P is transported to the second stacker 45 through the second sheet transport path R2. A third sheet transport path R3 branches off from the first transport path R1 at a second branching region B2. The sheet P is transported to the saddle stapling unit 44 through the third sheet transport path R3. In the present exemplary embodiment, the second branching region B2 is located downstream of the first branching region B1 in the transport direction of the sheet P from the inlet 49 toward the end stapling unit 42 along the first transport path R1.

In the present exemplary embodiment, a switching gate 70 is disposed between the first branching region B1 and the second branching region B2. The switching gate 70 switches the path of the sheet P to one of the first to third transport paths R1 to R3. Pairs of transport rollers 90 (transport units) are disposed in each of the first to third transport paths R1 to R3. The pairs of transport rollers 90, which are pairs of roller-like rotating members, transport the sheet P along the sheet transport path.

Punching Unit 41

The punching unit 41 is disposed adjacent to the inlet 49. The punching unit 41 punches, for example, two or four holes in the sheet P transported to the first postprocessing device 40. The punching unit 41 includes a unit body 411 and a container 412. The unit body 411, which has punching blades, punches, for example, two or four holes in the sheet P. The container 412 is disposed below the unit body 411 and receives punching scraps generated during punching by the unit body 411. The punching unit 41 further includes a partition wall 413 disposed between the container 412 and an inner region in the first postprocessing device 40. The partition wall 413 separates a space in which the container 412 is disposed from an inner part of the first postprocessing device 40.

End Stapling Unit 42

Next, the end stapling unit 42 will be described.

The end stapling unit 42 includes a sheet accumulation unit 60 and a stapler 69. The sheet accumulation unit 60, which includes a support plate 67 that is inclined and that supports the sheet P from below, accumulates a necessary number of the sheets P and forms a stack of the sheets P. The stapler 69 staples an end portion of the stack of the sheets P, which has been formed by the sheet accumulation unit 60. The end stapling unit 42 includes a transport roller 61 that is rotatable. The transport roller 61 transports the stack of the sheets P, which has been formed by the sheet accumulation unit 60, to the first stacker 43. The end stapling unit 42 further includes a movable roller 62 that is movable between a position at which the movable roller 62 is separated from the transport roller 61 and a position at which the movable roller 62 is pressed against the transport roller 61.

When the end stapling unit 42 performs a stapling operation, first, the end stapling unit 42 receives the sheet P, which has been transported from the folding device 30 (see FIG. 1), at the inlet 49. Subsequently, the sheet P is transported along the first transport path R1 and reaches the end stapling unit 42. The sheet P is transported to a position above the support plate 67 and falls onto the support plate 67. Then, the sheet P is supported by the support plate 67 from below and slides over the support plate 67 due to the inclination of the support plate 67.

Subsequently, the sheet P abuts against an end guide 64, which is attached to an end portion of the support plate 67. To be specific, in the present exemplary embodiment, the end guide 64 extends upward from the end portion of the support plate 67, and the sheet P that has slid over the support plate 67 abuts against the end guide 64. Thus, the sheet P is stopped in this way in the present exemplary embodiment. This operation is performed every time the sheet P is transported from the upstream side. As a result, a stack of the sheets P, in which the trailing ends of the sheets P are aligned with each other, is formed on the support plate 67.

Although not described above, in the present exemplary embodiment, a widthwise-position alignment member 65 is used to align the position of the stack of the sheets P in the width direction. In the present exemplary embodiment, every time the sheet P is fed onto the support plate 67, the widthwise-position alignment member 65 presses an end (side edge) of the sheet P in the width direction, thereby aligning the positions of the sheets P (stack of the sheets P) in the width direction.

When a predetermined number of the sheets P have been stacked on the support plate 67, a staple head 51 of the stapler 69 staples an end portion of the stack of the sheets P. The staple head 51 staples the stack of the sheets P by driving a metal staple (U-shaped wire) through the stack of the sheets P. Subsequently, in the present exemplary embodiment, the movable roller 62 moves toward the transport roller 61 so that the stack of the sheets P is nipped between the movable roller 62 and the transport roller 61. Subsequently, the transport roller 61 is rotated, and the stack of the sheets P, which has been stapled, is transported to the first stacker 43.

Saddle Stapling Unit 44

Next, the saddle stapling unit 44 will be described.

As illustrated in FIG. 2, the saddle stapling unit 44 includes a sheet accumulation unit 441, an output roller 442, and an end guide 443. The sheet accumulation unit 441 (support unit), which is disposed so as to be inclined with respect to the vertical direction, accumulates a necessary number of the sheets P on which images have been formed. The output roller 442 outputs the sheet P, which has been transported along the third sheet transport path R3, to the sheet accumulation unit 441. The end guide 443 (abutment unit) moves along the sheet accumulation unit 441 to determine the saddle stapling position and the saddle folding position. The saddle stapling unit 44 further includes plural sheet alignment members 444 that transport the sheets P accumulated on the sheet accumulation unit 441 toward the end guide 443. In the example illustrated in FIG. 2, the sheet alignment members 444 are rotary paddles.

The saddle stapling unit 44 further includes a sheet width aligning member 445 and a stapler 446 (postprocessing unit). The sheet width aligning member 445 includes a pair of guide plates that slide along the sheet accumulation unit 441 so as to align the sheets P in the width direction. The stapler 446 (postprocessing unit) saddle staples the stack of the sheets P accumulated on the sheet accumulation unit 441. The saddle stapling unit 44 further includes a folding knife 447, a pair of folding rollers 448, and a pair of transport rollers 449. The folding knife 447 moves from the back side toward the front side of the sheet accumulation unit 441 to fold the stack of the sheets P, which has been saddle stapled by the stapler 446, at the saddle stapled position. The folding rollers 448 nip the stack of the sheets P therebetween after the folding knife 447 has started folding the stack of the sheets P. The transport rollers 449 transport the stack of the sheets P, which is nipped by the folding roller 448, toward the second postprocessing device 50. The saddle stapling unit 44 further includes an image sensor Sr (detection unit) that detects an adjustment image T (see FIG. 3B) on the sheet P placed on the sheet accumulation unit 441.

The first postprocessing device 40 makes a saddle-folded/saddle-stapled booklet as follows. First, the sheet P is received at the inlet 49, and the sheet P is transported along the first transport path R1 until the trailing end of the sheet P reaches the switching gate 70. At this time, the switching gate 70 is positioned so as to guide the sheet P to the first transport path R1 (end stapling unit 42). After the trailing end of the sheet P has reached the switching gate 70, the sheet P is temporarily stopped.

Subsequently, the switching gate 70 is driven so that the trailing end of the sheet P is pushed by the switching gate 70, and the trailing end of the sheet P enters the third sheet transport path R3. Then, one of the pairs of transport rollers 90 (a pair of transport rollers 90A) start rotating in the reverse direction. Thus, the sheet P is started to be transported along the third sheet transport path R3 to the output roller 442 of the saddle stapling unit 44. Then, the output roller 442 transports the sheet P toward the sheet accumulation unit 441. Thereafter, this operation is repeatedly performed every time a new sheet P is transported to the first postprocessing device 40.

Accordingly, a predetermined number of, such as five or ten, sheets P are accumulated on the sheet accumulation unit 441. When the sheets P are being accumulated on the sheet accumulation unit 441, the sheet alignment members 444 press the sheets P against the end guide 443 to assist sheet alignment. The sheet width aligning member 445 slides in the width direction of the sheets P accumulated on the sheet accumulation unit 441 to align the accumulated sheets P in the width direction.

Depending on the size of the sheets P, after a predetermined number of the sheets P have been accumulated on the sheet accumulation unit 441, the end guide 443 moves upward so that a middle portion of (a stack of) the sheets P is located at the stapling position of the stapler 446. At this time, the stack of the sheets P is pushed upward by the end guide 443 along the sheet accumulation unit 441. In a case where the stack of the sheets P is long, the stack is moved upward along a broken line 3A in FIG. 2.

In this case, the leading end of the stack of the sheets P may abut against the punching unit 41 and the movement of the sheets P may be hindered. However, with the present exemplary embodiment, the movement of the stack of the sheets P is not hindered, because the stack of the sheets P is guided by the partition wall 413 of the punching unit 41 to a path on a side of the punching unit 41. Note that the partition wall 413 may be omitted and a side surface of the container 412 may be used to guide the stack of the sheets P to a path on a side of the punching unit 41.

When the middle portion of the sheets P reaches the stapling position of the stapler 446, the stapler 446 saddle staples a portion (for example, the middle portion) of the sheets P. After being saddle stapled, the end guide 443 is moved downward, and the stack of the sheets P is moved so that a folding portion (for example, the middle portion) of the sheet P coincides with the position of the end of the folding knife 447. The folding knife 447 is disposed behind the sheet accumulation unit 441 while the sheets P are being accumulated on the sheet accumulation unit 441, the sheets P are being saddle stapled by the stapler 446, and the sheets P are being transported after having been saddle stapled.

After the folding position of the stack of the sheets P has moved to the position of the end of the folding knife 447, the folding knife 447 is pushed from the back side toward the front side of the sheet accumulation unit 441. Thus, the folding knife 447 protrudes through an opening (not shown), which is formed in the sheet accumulation unit 441, toward the front side of the sheet accumulation unit 441. As the folding knife 447 protrudes, the middle portion of the stack of the sheets P is pushed toward the folding rollers 448 and nipped by the folding rollers 448. Subsequently, the folding rollers 448 transport the stack of the sheets P downstream to the transport rollers 449. The transport rollers 449 transport the stack of the sheets P, which has been saddle-folded/saddle-stapled, to the second postprocessing device 50.

Sheet Accumulation Unit 441 and Surrounding Components

Figure 3A:
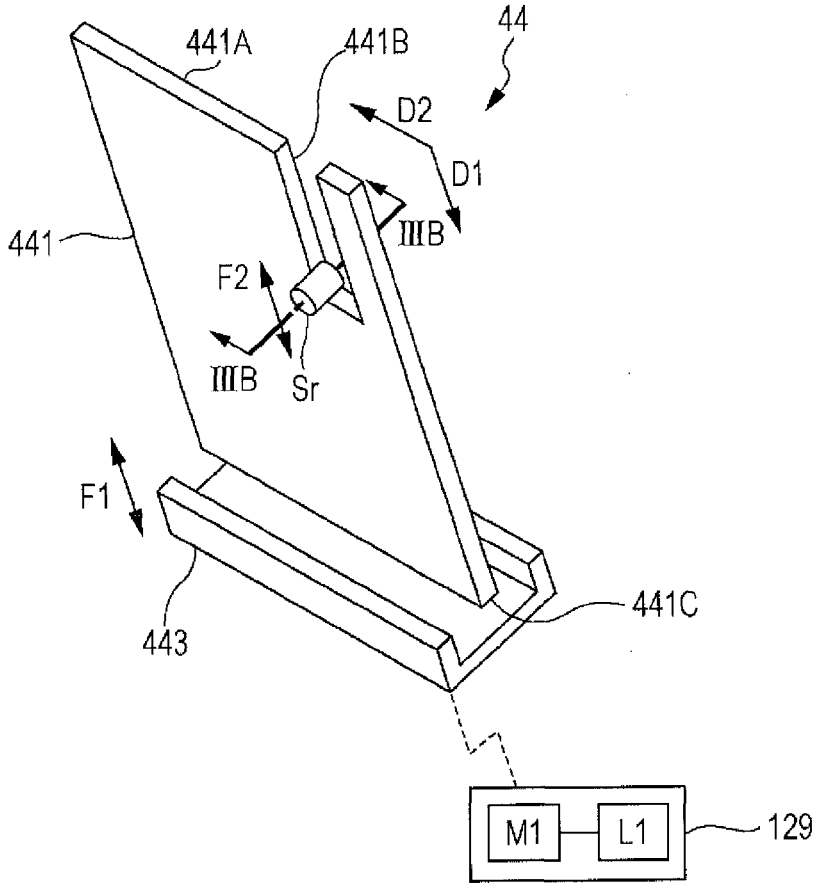
FIGS. 3A and 3B illustrate a sheet accumulation unit and surrounding components.
Figure 3B:
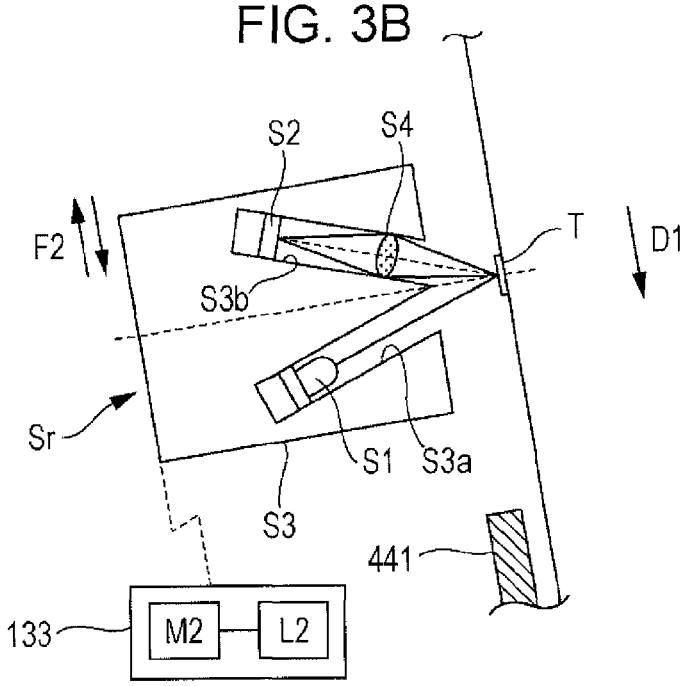

Referring to FIGS. 3A and 3B, the sheet accumulation unit 441 of the saddle stapling unit 44 and surrounding components will be described. FIGS. 3A and 3B illustrate the sheet accumulation unit 441 and surrounding components. To be specific, FIG. 3A is a perspective view of the sheet accumulation unit 441 and surrounding components. FIG. 3B is a schematic cross-sectional view of the image sensor Sr, taken along line IIIB-IIIB in FIG. 3A. The cross section is parallel to the transport direction of the sheet P.

Hereinafter, as illustrated in FIG. 3A, "sheet transport direction D1" refers to a direction in which the sheet P is transported along the sheet accumulation unit 441 toward the end guide 443, and "intersecting direction D2" refers to a direction that intersects (is perpendicular to) the sheet transport direction D1.

As illustrated in FIG. 3A, the sheet accumulation unit 441 has an upper surface that is inclined with respect to the vertical direction. In the example illustrated in FIG. 3A, a cutout 441B is formed in a portion of the sheet accumulation unit 441 near an upper end 441A. An image sensor Sr is disposed so as to face the cutout 441E of the sheet accumulation unit 441. The end guide 443 is disposed so as to straddle a lower end 441C of the sheet accumulation unit 441.

The sheet accumulation unit 441 is a plate-shaped member having an upper surface on which the sheets P are accumulated. The cutout 441B (through-hole), which is formed in the sheet accumulation unit 441, has a length in the sheet transport direction D1. The cutout 441B is located above a middle portion of the sheet accumulation unit 441 in the sheet transport direction D1.

The end guide 443 has a substantially U-shaped cross section and has a length in the intersecting direction D2. The end guide 443 is provided with an end guide driver 129 including a motor M1 and a drive transmission mechanism L1. The drive transmission mechanism L1 is a known mechanism such as rack and pinion. The end guide driver 129 is capable of detecting the position of the end guide 443 using the step number of the motor M1 or the like. The end guide 443 is capable of moving in the sheet transport direction D1 by receiving a driving force from the motor M1 of the end guide driver 129 through the drive transmission mechanism L1 (see arrow F1 in FIG. 3A).

As illustrated in FIG. 3B, the image sensor Sr includes a light-emitting element S1 and a light-receiving element S2. The light-emitting element S1 emits a near-infrared light beam through the cutout 441B toward a surface of the sheet P placed on the sheet accumulation unit 441. The light-receiving element S2 receives a reflected light beam (near-infrared light beam) of the light beam emitted from the light-emitting element S1 and reflected by an adjustment image T formed on the surface of the sheet P and outputs a detection signal. The image sensor Sr has an opening that faces the sheet P. The image sensor Sr further includes a housing S3 that contains the light-emitting element S1 and the light-receiving element S2.

An exit slit S3*a* and an entry slit S3*b* are formed in the housing S3. The exit slit S3*a* guides a light beam emitted from the light-emitting element S1 toward the sheet P. The entry slit S3*b* guides a reflected light beam from the sheet P toward the light-receiving element S2. A lens S4 is disposed in the entry slit S3*b*. The lens S4 focuses the reflected light beam from the sheet P to the light-receiving element S2.

The exit slit S3*a* is disposed at an angle of, for example, 70° with respect to the sheet P. The entry slit S3*b* is disposed at an angle of, for example, 110° with respect to the sheet P. Therefore, in the example illustrated in FIG. 3B, a portion of a light beam emitted from the light-emitting element S1 and regularly reflected by the adjustment image T, which is on the sheet P, enters the light-receiving element S2.

The image sensor Sr is provided with a sensor driver 133 (see FIG. 4) including a motor M2 and a drive transmission mechanism L2. The drive transmission mechanism L2 is a known mechanism such as rack and pinion. The sensor driver 133 is capable of detecting the position of the image sensor Sr using the step number of the motor M2 or the like. The image sensor Sr is capable of moving in the sheet transport direction D1 by receiving a driving force from the motor M2 of the sensor driver 133 through the drive transmission mechanism L2 (see arrow F2 in FIG. 33).

In the present exemplary embodiment, the image sensor Sr moves in a region located above the stapler 446 or the folding knife 447, which performs a postprocessing operation on the stack of the sheets P accumulated on the sheet accumulation unit 441. Moreover, the region is located on the upper end 441A side from a middle portion of the sheet accumulation unit 441 in the sheet transport direction D1.

Controller 100

Figure 4:
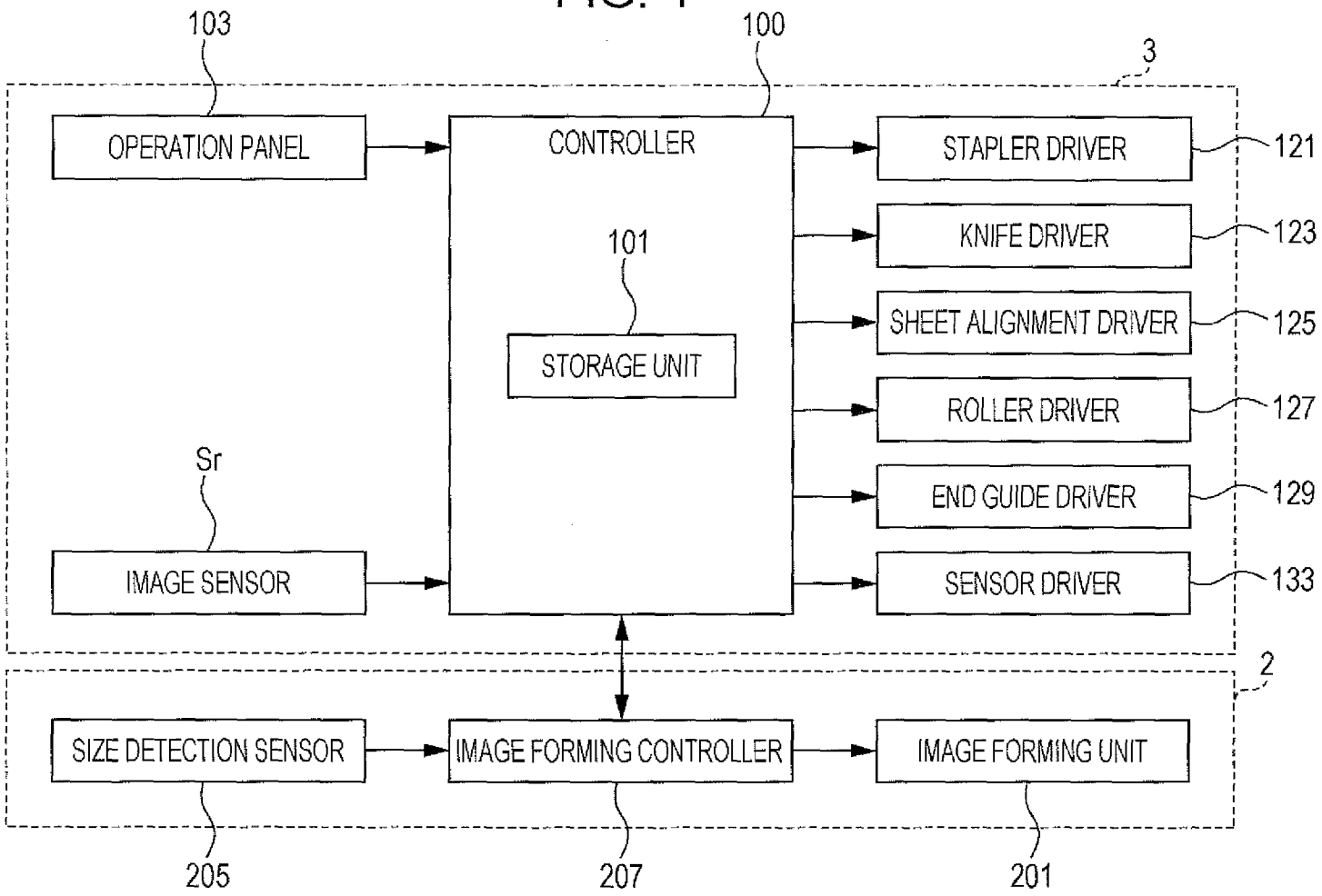
FIG. 4 is a functional block diagram of a controller.

Next, the function of the controller 100 will be described. FIG. 4 is a functional block diagram of the controller 100.

In the present exemplary embodiment, the controller 100 of the sheet processing apparatus 3 outputs information about an image forming operation to be performed on the sheet P to the image forming controller 207 of the image forming apparatus 2. On the basis of this information, the image forming controller 207 controls various mechanisms of the image forming apparatus 2.

The controller 100 includes a storage unit 101 that stores a table containing the movement amount of the end guide 443, image information about the adjustment image T, and a table containing the position at which the adjustment image T to be formed on the sheet P (described below in detail).

A stack-forming command signal and an adjustment command signal, which have been received through the operation panel 103, are input to the controller 100. The stack-forming command signal is used for forming the stack of the sheets P. The adjustment command signal is used for adjustment operations performed by the mechanisms of the sheet processing system 1 before forming the stack of the sheets P. Moreover, a detection signal of the adjustment image T is input to the controller 100 from the image sensor Sr.

The controller 100 outputs signals to a stapler driver 121, a knife driver 123, a sheet alignment driver 125, a roller driver 127, the end guide driver 129, and the sensor driver 133. The stapler driver 121 drives the stapler 446. The knife driver 123 drives the folding knife 447. The sheet alignment driver 125 drives/stops the sheet alignment members 444 and the sheet width aligning member 445 to align the stack of the sheets P accumulated to the sheet accumulation unit 441. The roller driver 127 drives/stops the transport rollers 90, the output roller 442, the folding rollers 448, and the transport rollers 449 to transport the sheet P. The end guide driver 129 drives the end guide 443. The sensor driver 133 drives the image sensor Sr. The controller 100 and the end guide driver 129 are an example of a changing unit or a driving unit.

A detection signal of the size of the sheet P is sent from the size detection sensor 205 and input to the image forming controller 207. The image forming controller 207 outputs information about the size of the sheet P to the controller 100 and outputs a control signal to the image forming unit 201.

It has been described that the controller 100 receives the stack-forming command signal and the adjustment command signal through the operation panel 103. Alternatively, for example, the controller 100 may receive the stack-forming command signal and the adjustment command signal through a personal computer (not shown) disposed outside the sheet processing system 1.

Position of Sheet P

Figure 5A:
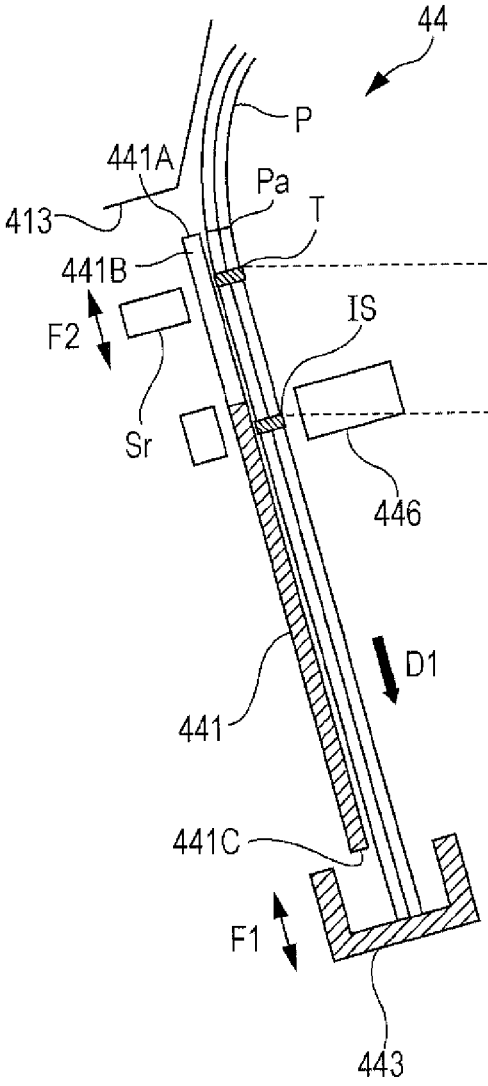
FIGS. 5A and 5B illustrate the position of a sheet placed on a sheet accumulation unit.
Figure 5B:
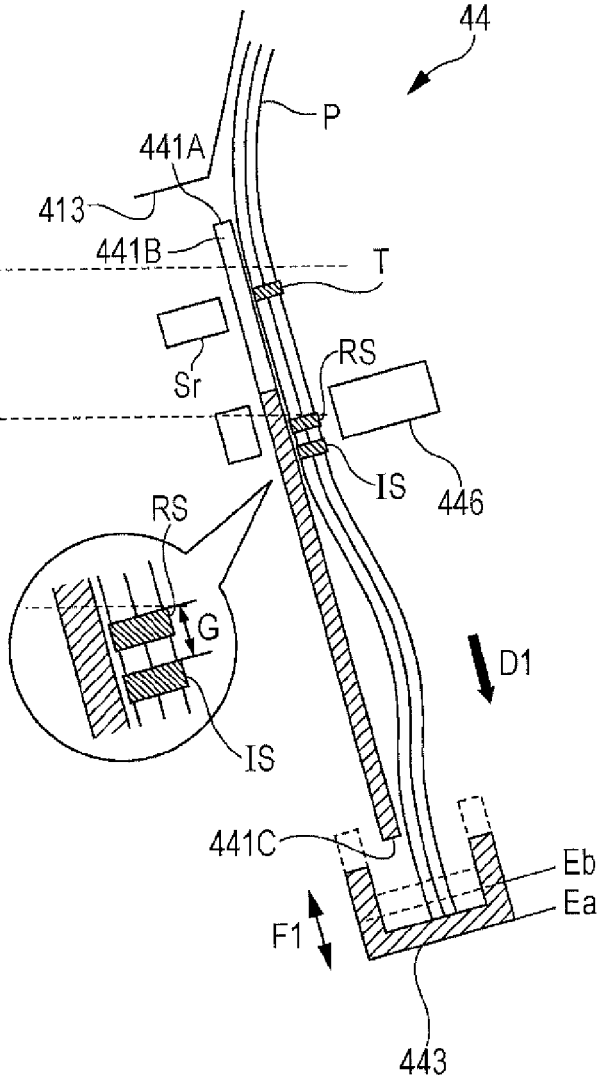

Referring to FIGS. 5A and 5B, the position of the sheet P placed on the sheet accumulation unit 441 will be described. FIGS. 5A and 5B illustrate the position of the sheet P placed on the sheet accumulation unit 441.

The position of the sheet P placed on the sheet accumulation unit 441 differs according to the rigidity of the sheet P. To be specific, bending of the sheet P on the sheet accumulation unit 441, that is, the amount of bending of the sheet P differs according to the rigidity of the sheet P. To be specific, as illustrated in FIG. 5A, when the sheet P has a high rigidity, the amount of bending of the sheet P is small. As illustrated in FIG. 5B, when the sheet P has a low rigidity, the amount of bending of the sheet P is large. For example, tracing paper has a rigidity lower that that of plain paper, so that the amount of bending of tracing paper is large.

Here, it is assumed that the stapler 446 staples the middle portion, in the sheet transport direction D1, of the sheet P placed on the sheet accumulation unit 441. Hereinafter, "ideal stapling portion IS" will refer to a portion of the sheet P to be stapled (which is in the middle in the sheet transport direction D1), and "actual stapling portion RS" refers to a portion of the sheet P that is actually stapled.

As described above, the amount of bending of the sheet P differs according to the rigidity of the sheet P. Therefore, the position of the ideal stapling portion IS of the sheet P relative to the sheet accumulation unit 441 in FIG. 5A differs from that in FIG. 5B. In the example illustrated in FIGS. 5A and 5B, the ideal stapling portion IS in FIG. 5B is lower than that in FIG. 5A, because the amount of bending of the sheet P in FIG. 5B is larger than that of FIG. 5A.

Therefore, if the positional relationship between the sheet accumulation unit 441 and the end guide 443 were adjusted so as to correspond to the ideal stapling portion IS of the sheet P in FIG. 5A and a stapling operation were performed on the sheet P in FIG. 5B, which has a different rigidity, the actual stapling portion RS of the sheet P in FIG. 5B would be displaced from the ideal stapling portion IS in FIG. 5B (see arrow G in FIG. 5B). To be specific, the actual stapling portion RS of the sheet P in FIG. 5B is located above the ideal stapling portion IS along the sheet accumulation unit 441.

In the description above, displacement of the actual stapling portion RS from the ideal stapling portion IS occurs when the stapler 446 performs a stapling operation, which is an example of a postprocessing operation, on the sheet P. Although not described in detail here, also when the folding knife 447 performs a folding operation on the sheet P, displacement of an actual folding position from an ideal folding position may occur due to the variation in the rigidity of the sheet P.

Stapling Operation Performed by Saddle Stapling Unit 44

In order to suppress displacement of the position at which a postprocessing operation is performed on the sheet P, with the present exemplary embodiment, the positional relationship between the sheet accumulation unit 441 and the end guide 443 is changed in accordance with the amount of bending of the sheet P. Referring to FIG. 5, a stapling operation performed by the saddle stapling unit 44 according to the present exemplary embodiment will be described.

As illustrated in FIGS. 5A and 5B, in a case where the adjustment image T is formed at a predetermined position on the sheet P by the image forming apparatus 2 (as described below in detail), the position of the adjustment image T relative to the sheet accumulation unit 441 varies in accordance with the amount of bending of the sheet P. In the example illustrated in FIGS. 5A and 5B, in a case where the sheet P in FIG. 5B is used, the image sensor Sr detects the adjustment image T at a position lower (closer to the end guide 443) than that in a case where the sheet P in FIG. 5A is used.

Therefore, in the present exemplary embodiment, the position of the end guide 443 is adjusted in accordance with the position of the adjustment image T. For example, the position of the end guide 443 is adjusted during an operation of forming a stack of the sheet P in order to adjust mechanisms of the sheet processing system 1 (so-called test printing) before the sheet processing system 1 performs a postprocessing operation.

To be specific, when the stack of the sheets P is placed on the sheet accumulation unit 441, the image sensor Sr is moved (for example, upward) in the sheet transport direction D1 (see arrow F2) until the image sensor Sr detects the adjustment image T. In accordance with the position at which the image sensor Sr detects the adjustment image T, the controller 100 adjusts the position of the end guide 443 relative to the sheet accumulation unit 441 (see arrow F1).

In the example illustrated in FIGS. 5A and 5B, the position Eb at which the end guide 443 is located when the stapler 446 performs a stapling operation on the sheet P is located above the position Ea (home position) of the end guide 443 in the case where the sheet P in FIG. 5A is used. Thus, for example, the ideal stapling portion IS is raised to a position facing the stapler 446, and, as a result, displacement of the actual stapling portion RS from the ideal stapling portion IS on the sheet P is suppressed.

The image sensor Sr not only detects the position of the adjustment image T formed on the sheet P but also determines whether or not the waveform of the detection signal corresponds to that of the adjustment image T. That is, the image sensor Sr is prevented from determining that the waveform of the detection signal of an object other than the adjustment image T, such as a smudge, as the waveform of the detection signal of the adjustment image T. For example, the image sensor Sr compares the size of the adjustment image T, which has been stored beforehand, with the size of an object detected, which is calculated from the rise time and the fall time of the waveform of the detection signal of the object and the movement speed of the image sensor Sr. Then, the image sensor Sr determines whether or not the waveform of the detection signal is that of the adjustment image T on the basis of the comparison result.

Adjustment Image T

Referring to FIGS. 5A to 6E, the adjustment image T formed on the sheet P will be described. FIGS. 6A and 6C to 6E illustrate adjustment images T, and FIG. 6B is a table related to the adjustment images T.

Figures 6A, 6B:
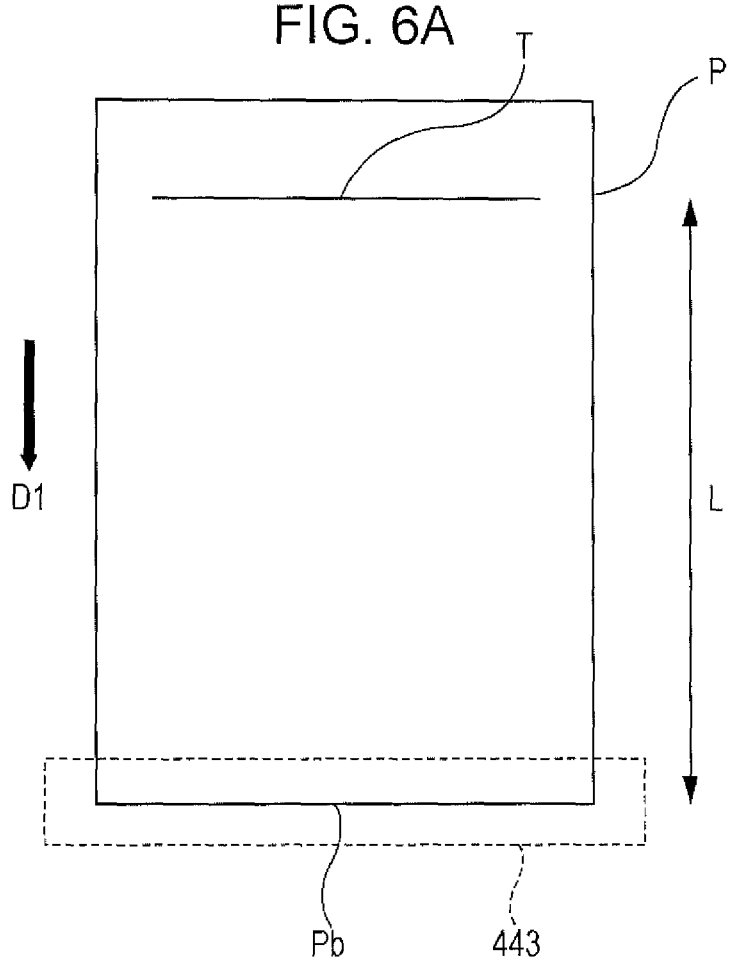
FIG. 6A illustrates an adjustment image, and 6B is a table related to the adjustment image.

As illustrated in FIG. 6A, the adjustment image T is formed at a predetermined position on the sheet P. To be specific, the adjustment image T is formed at a position on the sheet P separated by a predetermined distance L upstream in the sheet transport direction D1 from an end portion Pb of the sheet P abutting against the end guide 443. The distance L is determined so that, when the sheet P is placed on the sheet accumulation unit 441, the adjustment image T is located above (upstream in the sheet transport direction D1 of) a position at which the stapler 446 performs a stapling operation on the stack of the sheets P and a position at which the folding knife 447 performs a folding operation on the stack of the sheets P and below (downstream in the sheet transport direction D1 of) the upper end 441A of the sheet accumulation unit 441.

When the sheet P is placed on the sheet accumulation unit 441, bending of the sheet P is more likely to occur in a lower portion of the sheet P in the vertical direction. Therefore, by forming the adjustment image T in a region above a position at which the stapler 446 performs a stapling operation and a position at which the folding knife 447 performs a folding operation, it is possible to detect the position of the sheet P more accurately than in a case where the adjustment image T is formed below these positions.

As illustrated in FIGS. 5A and 5B, when the sheet P is large (is long in the sheet transport direction D1), a portion of the sheet P is located above the upper end 441A of the sheet accumulation unit 441. The portion of the sheet P located above the upper end 441A of the sheet accumulation unit 441 is not directly supported by the sheet accumulation unit 441. Therefore, the position of this portion of the sheet P relative to the sheet accumulation unit 441 may be unstable as compared with that of a portion of the sheet P located below the upper end 441A of the sheet accumulation unit 441.

Therefore, in the present exemplary embodiment, the distance L is determined so that, when the sheet P is placed on the sheet accumulation unit 441, the adjustment image T is located at a position below the upper end 441A of the sheet accumulation unit 441.

Apart from the present exemplary embodiment, the amount of bending of the sheet P may be detected by detecting an end portion of the sheet P. In this case, however, if the end portion of the sheet P is located above the upper end 441A of the sheet accumulation unit 441, the position of the end portion varies in accordance with the position of the sheet P. The present exemplary embodiment detects the adjustment image T located below an upper end Pa (see FIGS. 5A and 5B) of a portion of the sheet P that is supported by the sheet accumulation unit 441, and therefore it is possible to detect the amount of bending of the sheet P more accurately.

The distance L may be determined in accordance with the size and orientation of the sheet P. Alternatively, the distance L may be a predetermined value that is not dependent on the size and orientation of the sheet P.

As illustrated in FIG. 6B, in the case where the distance L is determined in accordance with the size and orientation of the sheet P, the distance L is determined, for example, on the basis of a table containing the correspondence between the distance L and the size and orientation of the sheet P. A first group, for which the distance L is La, includes JIS A3 short edge feed (SEF), legal short edge feed (SEF), JIS A4 short edge feed (SEF), and letter short edge feed (SEF). A second group, for which the distance L is Lb, includes JIS A4 long edge feed (LEF) and letter long edge feed (LEF). Note that these groups are only examples. This table is stored, for example, in the storage unit 101 of the controller 100.

Figure 6C:
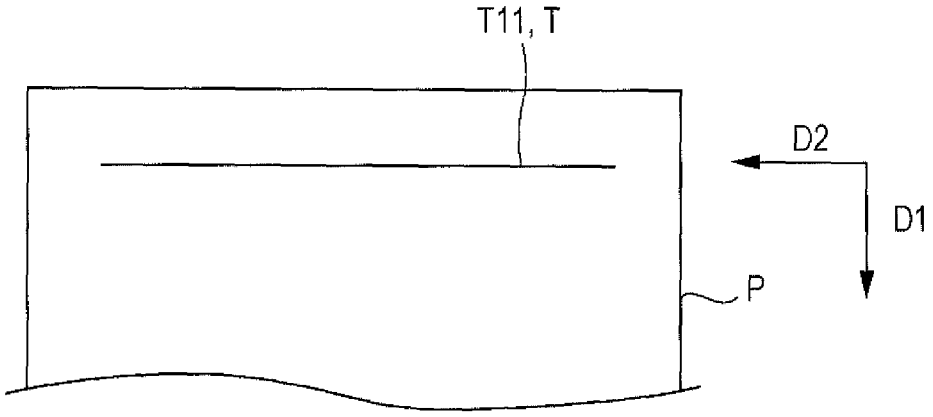
FIGS. 6C to 6E illustrate adjustment images.

As illustrated in FIG. 6C, the adjustment image T may be a linear image T11 extending in the intersecting direction D2. Alternatively, the adjustment image T may be a rectangular image having a length in the intersecting direction D2. Because the adjustment image T includes a portion extending in the intersecting direction D2, the probability that the image sensor Sr is unable to detect the adjustment image T when the position of the adjustment image T relative to the image sensor Sr is displaced in the intersecting direction D2 is reduced.

Figure 6D:
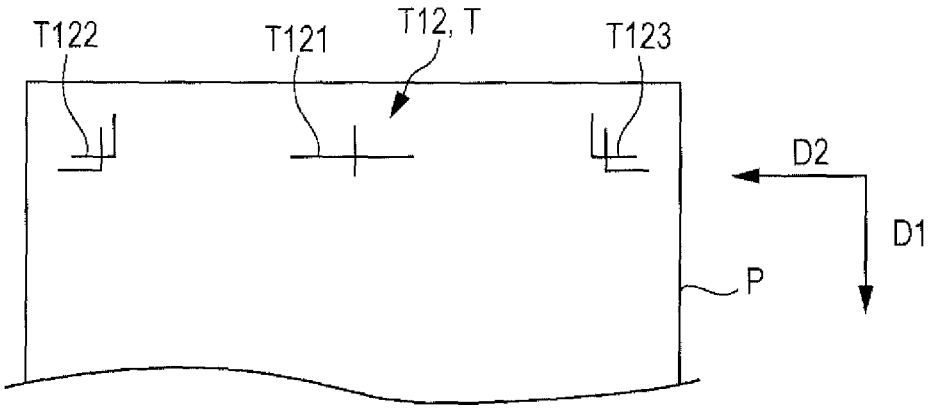

As illustrated in FIG. 6D, so-called "cross marks", which are marks used to adjust the position at which the sheet P is cut or positioning (registration) when performing multicolor printing, may be used as an adjustment image T12 (including T121 to T123). Alternatively, as illustrated in FIG. 6E, an image (patch) formed on the sheet P in order to adjust the concentration of toners of different colors used in the image forming apparatus 2 may be used as an adjustment image T13.

Figure 6E:
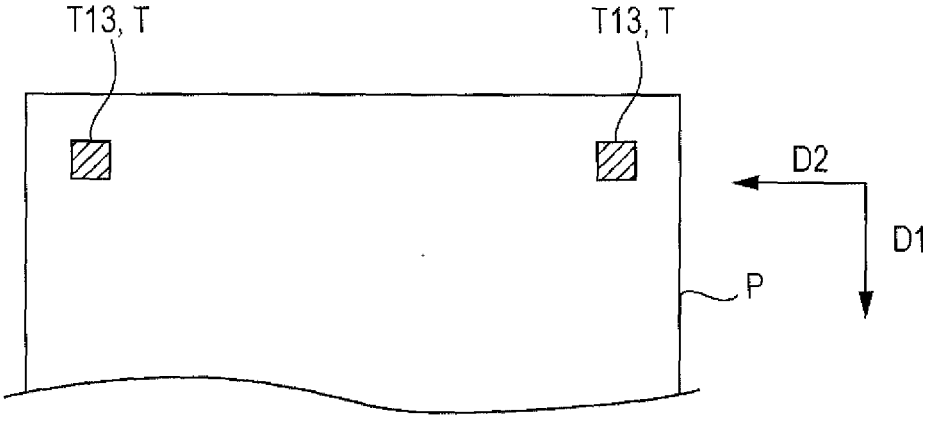

As illustrated in FIGS. 6D and 6E, plural adjustment images T12 and T13 may be formed at positions separated in the intersecting direction D2. In this case, plural image sensors Sr may be disposed so as to each face a corresponding one of the adjustment images T. Then, it is possible to detect the position of the adjustment image T more accurately by calculating the average value of the detection signals generated by the image sensor Sr when detecting the adjustment images T. In addition, by using plural image sensors Sr, it is possible to detect skewing of the sheet P.

In the description above, the adjustment image T is formed in order to adjust the position of the end guide 443. Alternatively, for example, a part of or the entirety of an image that is formed on the sheet P in a process performed upon a user's request may be used as the adjustment image T.

Process Performed by Controller 100

Figure 7:
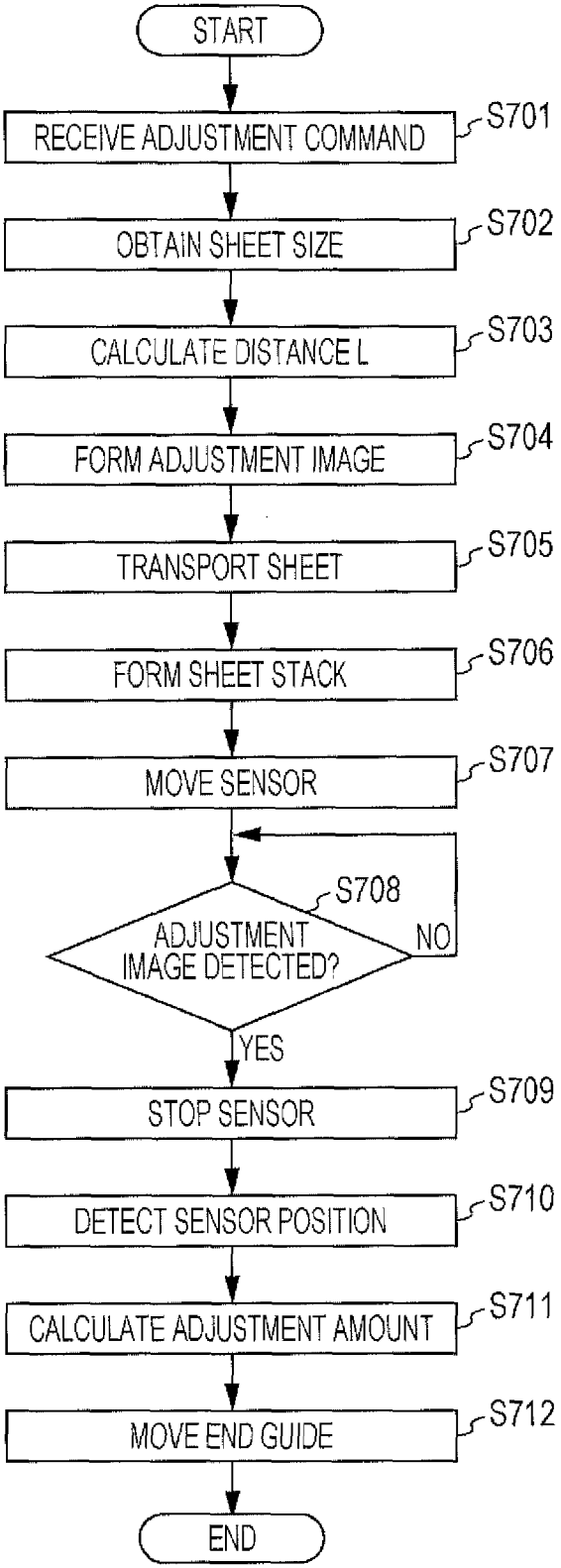
FIG. 7 is a flowchart representing a process performed by a controller.

Referring to FIG. 7, a process performed by the controller 100 to adjust the position of the end guide 443 will be described. FIG. 7 is a flowchart representing the process performed by the controller 100.

First, the controller 100 receives an adjustment command signal through the operation panel 103 (step S701). The controller 100 receives a detection signal of the size of the sheet P from the size detection sensor 205 through the image forming controller 207 (step S702). The controller 100 calculates the distance L on the basis of the detection signal (step S703). The controller 100 outputs a command signal to the image forming controller 207 so as to form the adjustment image T, which has been stored in the storage unit 101, at a position on the sheet P at the distance L (step S704).

The controller 100 causes the transport rollers 90 and the output roller 442 to transport the sheet P, on which the image forming apparatus 2 has formed the adjustment image T, to the sheet accumulation unit 441 (step S705). A stack of the sheets P is formed on the sheet accumulation unit 441 while the sheet alignment members 444 and the sheet width aligning member 445 are being driven (step S706). The number of the sheets P in the stack may be singular or plural. By making the number of the sheets P in the stack be the same as the number of sheets P in the stack that is formed in an actual process, it is possible to detect bending of the stack of the sheets P that occurs during a post-processing operation. As a result, the accuracy in adjusting the position of the end guide 443 is further increased.

The controller 100 drives the image sensor Sr in the sheet transport direction D1 by using the sensor driver 133 (step S707). The controller 100 determines whether or not the image sensor Sr, which is moving in the sheet transport direction D1, has detected the adjustment image T (step S708). If the image sensor Sr has detected the adjustment image T, the image sensor Sr is stopped (step S709). If the image sensor Sr has not detected the adjustment image T, the image sensor Sr continues moving.

The controller 100 causes the sensor driver 133 to detect the position at which the image sensor Sr is stopped (step S710). The controller 100 calculates an adjustment amount by which the end guide 443 is to be moved on the basis of the position of the image sensor Sr (step S711). The controller 100 causes the end guide driver 129 to move the end guide 443 by the calculated adjustment amount (step S712).

Although not illustrated, after the position of the end guide 443 has been adjusted, the stapler 446, the folding knife 447, and the like perform postprocessing operations on the stack of the sheets P. By performing postprocessing operations after the position of the end guide 443 has been adjusted, displacement of the positions on the sheet P at which postprocessing operations are performed is suppressed.

In step S711 described above, the controller 100 calculates the adjustment amount of the end guide 443, for example, as follows. First, with reference to a table stored in the storage unit 101, the controller 100 determines the adjustment amount of the end guide 443 in accordance with the position at which the image sensor Sr has detected the adjustment image T. The table contains the relationship between the detection position of the adjustment image T and the amount by which the end guide 443 is to be moved from the home position.

In the description above, the adjustment of the position of the end guide 443 is started through an operation performed on the operation panel 103 or the like. However, the adjustment may be started at another timing. Alternatively, for example, the adjustment may be performed when a command to form an image on the sheet P is received. Further alternatively, the adjustment operation may be started when, for example, the size detection sensor 205 detects a change in the size or type of the sheet P placed in the sheet feeding unit 203 of the image forming apparatus 2.

A user may input an amount (for example, 1 mm) by which the end guide 443 is to be moved through the operation panel 103 or the like, and the controller 100 may cause the end guide driver 129 to move the end guide 443 on the basis of the input amount. In this case, for example, it is possible to easily adjust the position of the end guide 443 when a user checks the stack of the sheets P, on which a postprocessing operation has been performed after the position of the end guide 443 had been adjusted on the basis of detection of the adjustment image T by the image sensor Sr as described above, and the user recognizes the necessary to further adjust the position of the end guide 443.

Modification

Figure 8A:
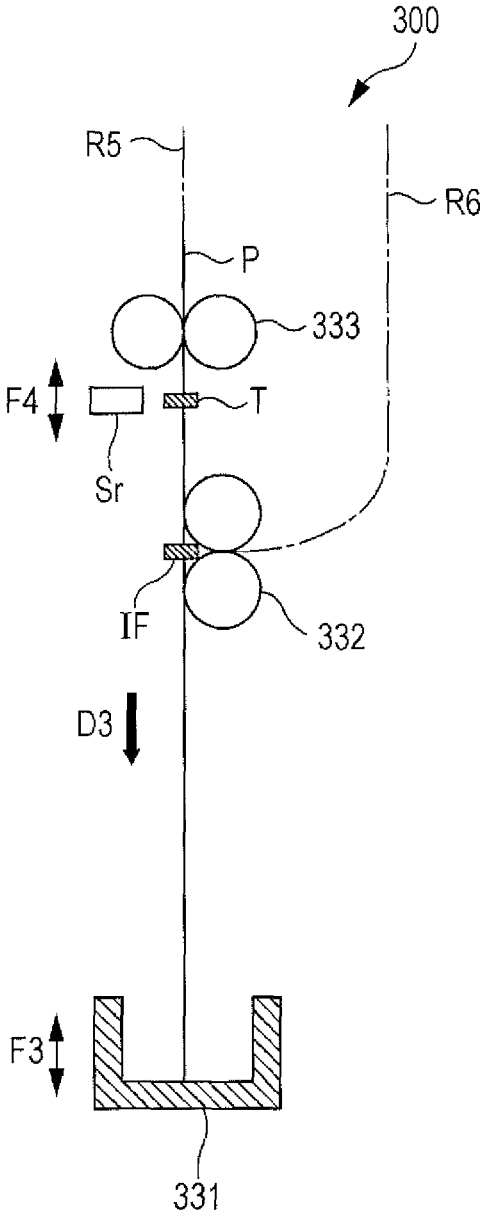
FIGS. 8A and 8B illustrate the positions of sheets according to a modification.
Figure 8B:
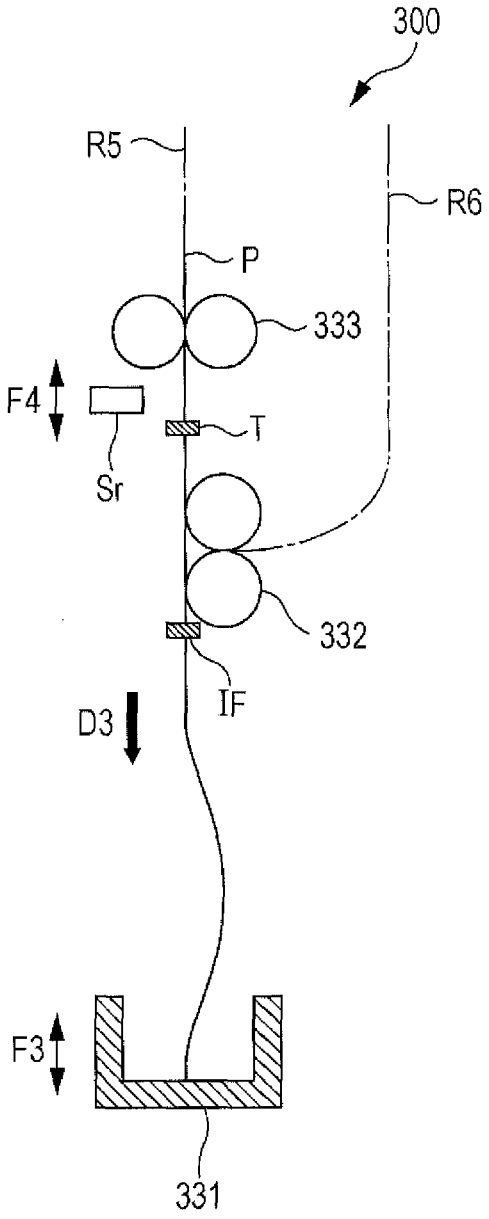

Referring to FIGS. 8A and 8B, a modification of the present exemplary embodiment will be described. FIGS. 8A and 8B illustrate the positions of the sheets P according to the modification.

In the description above, the saddle stapling unit 44 according to the present exemplary embodiment includes the sheet accumulation unit 441 and the end guide 443. The sheet accumulation unit 441, on which the sheets P are accumulated, may be omitted. For example, FIGS. 8A and 8B illustrate a folding unit 300, which performs a folding operation on the sheet P, according to the modification.

To be specific, as illustrated in FIG. 8A, a fifth sheet transport path R5 and a sixth sheet transport path R6 extend in the folding unit 300. The sheet P is transported upward along the fifth sheet transport path R5, which extends vertically. A sixth sheet transport path R6 branches off from a middle portion of fifth sheet transport path R5 and extends upward from the middle portion.

The folding unit 300 includes an end guide 331, a pair of folding rollers 332, and a pair of transport rollers 333. The end guide 331 moves back and forth along the fifth sheet transport path R5 in the transport direction D3 and stops the sheet P at a predetermined position. The folding rollers 332 are disposed upstream of the end guide 331 and perform a folding operation on the sheet P abutting against the end guide 331. The transport rollers 333 are disposed upstream of the folding roller 332.

The folding unit 300 further includes an image sensor Sr that detects an adjustment image T on the sheet P when the sheet P abuts against the end guide 331 after being transported along the fifth sheet transport path R5. The image sensor Sr is disposed below (on the downstream side in the sheet transport direction D3 of) the transport rollers 333 and above (on the upstream side in the sheet transport direction D3 of) the folding rollers 332.

When the folding unit 300 performs a folding operation, first, the transport rollers 333 transport the sheet P along the fifth sheet transport path R5 until the sheet P abuts against the end guide 331. Subsequently, the folding rollers 332 perform a folding operation on the sheet P by rotating so as to pull the sheet P abutting against the end guide 331 into a nip therebetween. After being folded, the sheet P is transported by the folding rollers 332 along the sixth sheet transport path R6.

The folding unit 300 is capable of changing the position at which the folding operation is performed on the sheet P by moving the end guide 331 back and forth (see arrow F3 in FIGS. 8A and 8B).

As illustrated in FIG. 8A, when the sheet P has a high rigidity, the amount of bending of the sheet P disposed in the folding unit 300 is small. As illustrated in FIG. 8B, when the sheet P has a low rigidity, the amount of bending of the sheet P is large. Therefore, the position of an ideal folding portion IF of the sheet P, on which a folding operation is to be performed, varies, and as a result, the actual position at which the sheet P is folded varies.

To prevent this, the image sensor Sr is reciprocated in the sheet transport direction D3 (see arrow F4 in FIGS. 8A and 8B) so as to change the position of the end guide 331, against which the sheet P abuts, in the sheet transport direction D3 (see arrow F3 in FIGS. 8A and 8B) in accordance with the position at which the image sensor Sr has detected the adjustment image T. Thus, variation in the position at which the sheet P is actually folded is suppressed.

In the description above, adjustment of the position at which a stapling operation or a folding operation is performed on the sheet P has been discussed. However, the position of an end portion of the sheet P may be adjusted when any postprocessing operation, such as a punching operation or a cutting operation, is performed on the sheet P.

In the description above, the image sensor Sr is disposed in such a way that the image sensor Sr is capable of detecting the adjustment image T that is formed on a surface (lower surface) of the stack of the sheets P facing the sheet accumulation unit 441. However, the image sensor Sr may be disposed at any position at which the image sensor Sr faces the adjustment image T formed on the sheet P. For example, in a case where the adjustment image T is formed on an opposite surface (upper surface) of the stack of the sheets P opposite to the surface facing the sheet accumulation unit 441, the image sensor Sr may be disposed so as to face the opposite surface.

In the description above, the position of the end guide 443 is adjusted in accordance with the position of the sheet P. However, it is only necessary to change the relative positions of the end guide 443 and a postprocessing device, such as the stapler 446. For example, the postprocessing apparatus may be moved relative to the end guide 443 or both the postprocessing apparatus and the end guide 443 may be moved.

In the description above, the amount of bending of the sheet P is changed in accordance with the rigidity of the sheet P. However, the amount of bending of the sheet P may be changed due to a factor other than the rigidity of the sheet P. For example, the amount of bending of the entirety of the stack of the sheets P differs according to the number of the sheets P in the stack of the sheets P. Moreover, the amount of bending of the entirety of the stack of the sheets P differs according to the length of the sheet P in the sheet transport direction D1 or in the intersecting direction D2, or the humidity and the temperature of ambient air. Therefore, the structure described above may be used in a case where such a factor, which may influence the amount of bending of the sheet P, changes.

In the description above, the position of the adjustment image T changes due to a change in the amount of bending of the sheet P. The structure described above may be used also in a case where the position of the adjustment image T changes due to other conditions of the sheet P, such as creases in the sheet P.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A postprocessing apparatus comprising:

a support unit that supports a sheet that is transported;

an abutment unit against which a leading end of the sheet supported by the support unit abuts;

a postprocessing unit that performs a postprocessing operation on the sheet abutting against the abutment unit;

a detection unit that detects an image formed at a predetermined position on the sheet and detects a position of the image when the sheet abuts against the abutment unit;

a changing unit that changes a position of the abutment unit relative to the postprocessing unit on the basis of the position of the image detected by the detection unit;

a first driving unit that moves the abutment unit closer to or away from the support unit in a vertical direction; and a second driving unit that moves the detection unit in a region located above the postprocessing unit, which performs the postprocessing operation on the sheet in the support unit, wherein the detection unit faces an upper end side of the support unit and is located above a middle of portion of the support unit.

2. The postprocessing apparatus according to claim 1, wherein the detection unit detects an image formed on a region of the sheet supported by the support unit, the region being located below an upper end of a portion of the sheet, the portion being supported by the support unit.

3. The postprocessing apparatus according to claim 1, wherein the detection unit detects an image formed on a region of the sheet supported by the support unit, the region being located above a portion of the sheet, the postprocessing unit performing the postprocessing operation on the portion of the sheet.

4. The postprocessing apparatus according to claim 1, wherein the detection unit detects a portion of an image formed on the sheet, the portion extending in a direction that intersects a sheet transport direction in which the sheet is transported to the abutment unit.

5. An image forming system comprising:

an image forming unit that forms an image on a sheet;

a transport unit that transports the sheet on which the image forming unit has formed an image;

a support unit that supports the sheet transported by the transport unit;

an abutment unit against which a leading end of the sheet supported by the support unit abuts;

a postprocessing unit that performs a postprocessing operation on the sheet abutting against the abutment unit;

a detection unit that detects an image formed at a predetermined position of the sheet and detects a position of the image when the sheet abuts against the abutment unit;

a first driving unit that moves the abutment unit closer to or away from the support unit in a vertical direction on the basis of the position of the image detected by the detection unit; and a second driving unit that moves the detection unit in a region located above the postprocessing unit, which performs the postprocessing operation on the sheet in the support unit, wherein the detection unit faces an upper end side of the support unit and is located above a middle of portion of the support unit.

6. An image forming system according to claim 5, wherein, the postprocessing unit performs the postprocessing operation on a first portion of the sheet supported by the support unit, the first portion being located below an upper end of a second portion of the sheet, the second portion being supported by the support unit.

* * * * *